United States Patent [19]

Carmody et al.

[11] 3,945,495

[45] Mar. 23, 1976

[54] HOUSEHOLD PLASTIC FILM IN ROLL FORM AND EMBODYING A CURLED LEADING EDGE

[75] Inventors: William D. Carmody; William Robb Roy Park, both of Midland; Gordon E. Gould, Breckenridge, all of Mich.

[73] Assignee: The Dow Chemical Company, Midland, Mich.

[22] Filed: Dec. 5, 1974

[21] Appl. No.: 529,883

[52] U.S. Cl. ..... 206/397; 428/195; 428/906

[51] Int. Cl.[2] ..... B65D 85/67

[58] Field of Search ..... 161/402; 206/389, 397, 206/412; 211/49 S; 428/906, 195; 225/11; 229/87 B

[56] References Cited

UNITED STATES PATENTS

| | | | |
|---|---|---|---|
| 1,949,259 | 2/1934 | Salsman | 206/389 |
| 2,857,047 | 10/1958 | Edelson | 206/412 |
| 3,201,030 | 8/1965 | Pollack | 229/87 B X |
| 3,204,949 | 9/1965 | Kieslich | 225/11 X |
| 3,712,463 | 1/1973 | Bestehorn | 206/449 X |

*Primary Examiner*—William Price
*Assistant Examiner*—Steven E. Lipman
*Attorney, Agent, or Firm*—Burke M. Halldorson

[57] ABSTRACT

Rolls of household or consumer type films or wrapping materials are provided with a curled leading edge that is ideally suited as a grasping tab for starting initial withdrawal of the film such as from a standard consumer type dispensing carton. The invention is applied to films exhibiting relatively high residual shrinkage or stress relaxation and is practiced by applying a coating to, or alternately solvent treating, the leading edge, in a manner that unbalances the rate of shrinkage at the opposite surfaces of the edge, thereby inducing a curling effect. Further attributes of such a starting feature would include easy identification of the leading edge, and the lessening of sensitivity to tear propagation such as from a notch or a like tear propagating flaw as may be left in the leading edge by the film cutter bar.

10 Claims, 3 Drawing Figures

HOUSEHOLD PLASTIC FILM IN ROLL FORM AND EMBODYING A CURLED LEADING EDGE

BACKGROUND OF THE INVENTION

Rolls of household film such as are commonly sold in a dispensing carton through the grocery trade, are customarily manufactured with a cling or adhesive surface character in order to enhance the functionality of the film as a wrapping. This creates a need for a roll starting feature since the leading edge of the roll has a tendency to block intimately against the underlying layer in a manner whereby it is difficult to locate or find the edge, and difficult to peel it away to start the roll. Roll starting means or convenience features as have been used or proposed in the past, however, have oftentimes not been entirely satisfactory from a manufacturing standpoint, or because of poor or inadequate functionality.

Referring to certain specifics, it has been a common expediency to employ incremental lengths of adhesive tape as a starting feature. The tape is folded upon itself to provide a grasping end, and the opposite end of the tape is fastened adhesively to the film. It has been a problem, however, to reliably or faultlessly register the tape with the leading edge of the roll at high manufacturing speeds. Also the tape has a tendency to tear the film since it doesn't lift the edge evenly across the entire width of the roll.

An embossed pattern may also serve to distinguish the edge of the film, and reduce blocking or sticking of the edge to the underlying layer, such as to serve the function of a roll starting feature. Embossing the film at high speeds, however, is difficult since the film is relatively fragile and susceptible to breaking upon repeated contact with the embossing plate. Maintaining adequately precise temperature control is also difficult since if the plate is too hot, it may excessively thin the film causing extreme proneness to tear propagation, whereas if it is too cold, the embossing may not be distinct enough to serve as a functionally good starting feature.

The leading edge of the film may also be coated to make it less likely to block and the coating can be pigmented to easily identify the leading edge. However, the foreign substance or coating that is used must meet certain applicable government regulations since household wrapping materials are frequently used to preserve food. Moreover, the coating must survive extreme warehouse storage temperatures, while maintaining its functionality, and must be compatible with application to the film at high speed. So far as is known, the art has not heretofore developed a commercially successful coating of this type for household films.

Accordingly, it would be of advantage to the art if there were available a roll of household film having an improved means for conveniently identifying and grasping the leading edge of the roll, such as to start a new roll from a standard dispensing carton.

It would be of further advantage if the design of such convenience feature were compatible with the high speed production of the film in roll form.

It would be of still even further advantage if such convenience feature in addition to its grasping and identifying function, effectively if not altogether eliminated the problem or the tendency of the leading edge of the roll to block against the underlying film layer, such as under severe and protracted warehouse temperature conditions.

It would be of yet even further advantage if such convenience feature in addition to some or all of the above noted characteristics, would comprise an effective deterrent to the tendency of the edge to tear propagate such as from notches or flaws unintentionally formed in the edge in manufacturing the roll.

BRIEF SUMMARY OF THE INVENTION

Briefly, the present invention utilizes the inherent tendency for delayed shrinkage of film due to relaxation of orentation imparted thereto by stretching the film longitudinally during its manufacture, to provide a unique and admirably suited means for starting a new roll of such film. The invention specifically contemplates the step of adhering a coating to, or alternately treating the leading edge of the roll in a manner that unbalances the degree of shrinkage at the opposite surfaces of the edge such that the edge will curl, preferably away from the surface of the roll. As can be readily appreciated, the invention not only provides a convenient indicator and grasping means for starting a new roll of household film, but in addition because it curls the leading edge, substantially eliminates the possibility of tears propagating from the edge due to a notch or like tear propagating flaw in the edge. Further, because the edge is in a curled posture, there is little possiblity that the coating (where used) will adhere or block against the roll such as under extreme warehouse storage temperatures.

The preferred embodiments of the present invention are shown in the accompanying drawings wherein.

DESCRIPTION OF THE PREFERRED EMBODIMENTS OF THE INVENTION

Figure 1:
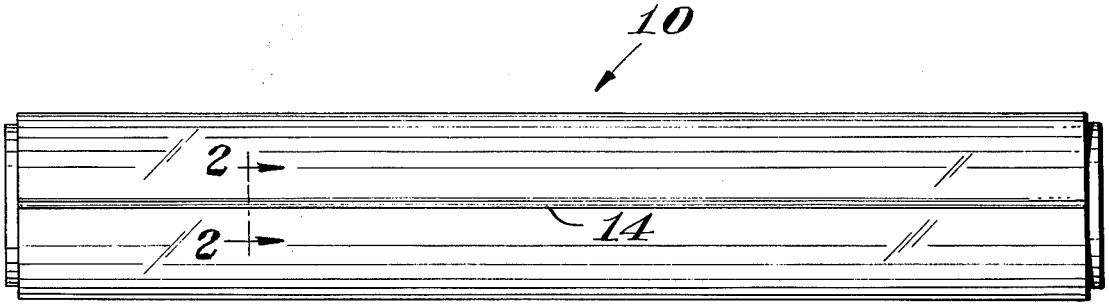
FIG. 1 is a front elevational view illustrating a roll of household film having the leading edge thereof curled backwardly away from the roll in order to provide a convenient grasping tab to start the roll.

The invention is broadly applicable to known synthetic resinous films or wrapping materials which can exhibit high degrees of shrinkage or dimensional contraction by treatment or by aging such as when placed in a non-restrained or relaxed position. However, whether or not any particular film will qualify as to the teachings herein would necessarily be determined by trial and error as relates to that particular film. Certain polyvinyl chloride films, for example, may contain too much plasticizer to respond to the coatings or treatments taught herein and thus would be inappropriate subjects as concerns this invention. Known polyethylene homopolymers and copolymers moreover may or may not respond to the practice of this invention depending on the degree of orientation imparted to the film during its manufacture, and depending possibly on the formulation and make-up of the film.

The preferred film material that responds particularly to the ends sought herein are household films made of the vinylidene chloride copolymers or saran films. This general type of film will accept high amounts of orientation. Moreover, when free of restraint, orientated saran films tend to shrink slowly even at or near room temperatures. For example, if saran film is wound on a core the leading edge of the roll of such film is in what may be referred to as a non-restrained position. As the roll ages at room temperature the edge shrinks backwardly or contracts in dimension. The underlying layers of the roll may exhibit a much lesser degree of shrinkage since the same are at least in a partially restrained state. Thus, the degree of shrinkage is most marked at the leading edge of the roll.

The invention utilizes this trait of orientated saran films, and any like thermoplastic films having similar character, to provide a convenient and inexpensive grasping tab to start a new roll of such film. Particularly, the invention teaches the application of a thin coating to one surface of the edge of the material as will adhere to the film and selectively restrain shrinkage of the film along that surface to which it is adhered. The opposite surface since it is not affected by the restraint function of the coating, will shrink to a greater degree whereby as the roll ages a curling effect is achieved along the leading edge of the roll.

A like result is possible also through solvent treatment of the leading edge, whereby a near immediate curling effect oftentimes can result. The solvent treatment may be applied to films of saran, polyethylene and known copolymers thereof, vinyl chlorides, and other synthetic resinous thermoplastics, provided the same have imparted thereto sufficient orientation during their manufacture to respond adequately to such treatment, i.e., to have induced thereon a curling effect by the action of the solvent to release orientation stress selectively at one surface of the film.

The invention is now discussed in detail in respect to the coating method and solvent treatment methods below.

COATED EDGE

Figure 2:
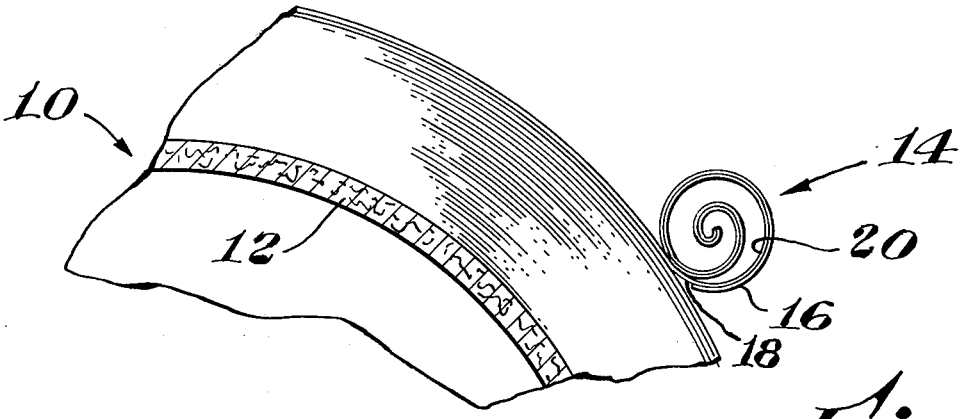
FIG. 2 is an enlarged partial view taken along section line 2—2 of FIG. 1, and illustrates the curled edge as viewed in cross-section.

The invention as it contemplates a coated edge is illustrated in FIGS. 1 and 2 wherein there is depicted a roll of household film 10 wound on a conventional hollow paper core 12. The roll 10 terminates in an upwardly and backwardly curled leading edge 14 which is thus adapted to present a convenient grasping tab to start the roll for dispensing and use purposes. This curled effect is induced by a thin coating layer 16 adhered to the underside or undersurface 18 of edge 14 (in reference to the original non-curled posture of the edge). Should the coating alternately have been applied to the opposite surface 20, the directionality of the curl would be reversed to that illustrated in FIG. 2, and functional in the general manner contemplated by these teachings.

The preferred coating material is a carnauba wax layer applied as a melt, and which is permitted to solidify on the film as a relatively hard, thin wax coating. Other coating materials, of course, may be substituted for the preferred material such as various known latexes, hot melts, and lacquers which would provide the essential performance of this wax.

A carnauba wax coating is preferred, however, for the reason that it solidifies at a fast rate whereby it is compatible with the high speed manufacture of rolls 10. Moreover, it is characteristically hard at normal environmental temperatures, thus having relatively good dimensional stability at or near room or manufacturing plant temperatures. Further it appears to nevertheless have sufficient flexibility to permit a pronounced curling effect.

The carnauba wax may be used in essentially pure form or in mixtures such as with micro-crystalline or paraffinic waxes. The latter waxes, however, if used in pure form, that is without mixture with carnauba wax, would normally be too soft to provide an adequate performance according to these teachings. The deficiency may be the result of insufficient dimensional stability whereby a softer wax does not provide an adequate restraining function on the surface to which it is adhered, and as a probable secondary causative factor, the softer wax is more likely to flow and attach or adhere the edge to the underlying layer of the roll. Should the restraint function be less than adequate, the desired curling effect may not occur at least to the extent desired; or should the edge adhere to the underlying layer, the edge may be prevented or restrained from assuming the curled posture desired by this invention.

SOLVENT TREATED EDGE

Figure 3:
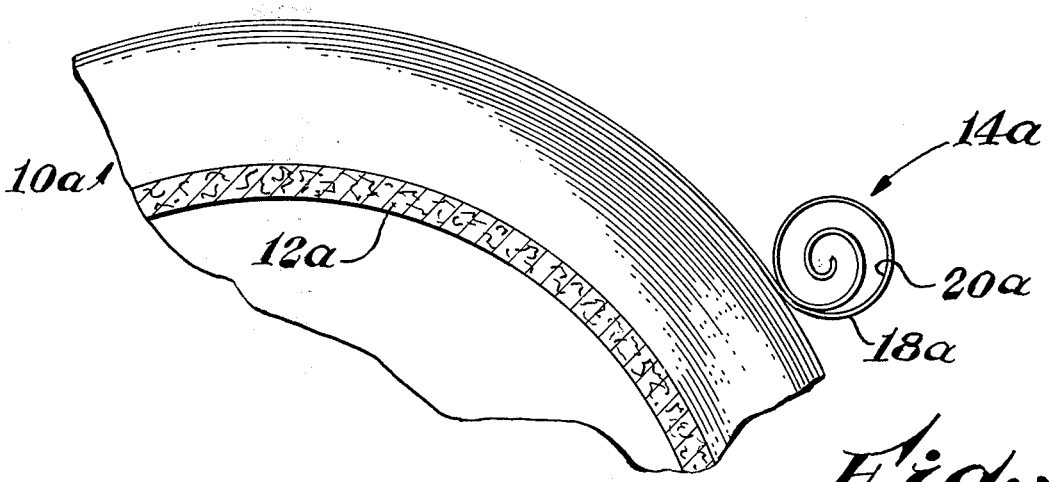
FIG. 3 is a view like FIG. 2 only showing a modified form of the invention.

Also as mentioned above, a solvent treatment of the edge may be utilized in order to accomplish the objectives of this invention. This embodiment is illustrated in FIG. 3 wherein like parts to the FIG. 1 embodiment are given corresponding reference numeral designations having the suffix "*a*". The solvent treatment will oftentimes result in a near immediate curling effect, although as the roll ages, the curl may change somewhat in degree to produce either a greater or lesser effect. For a saran film composition the preferred solvent is a methylethyl ketone which is brought to a boil, and the roll is passed through the refluxing vapor of the boiling solvent. This results in a near immediate curl of the edge of a saran film. Acetone, dimethyl ketone and dimethylene chloride may also be used.

The aforegoing solvents, and particularly methylethyl ketone may also be applied to highly orientated ethylene homopolymer and copolymer films in order to induce a curling effect. The tightness of the curl will usually be more pronounced with saran films however, and may comprise in regard particularly to the latter, several or more turns. Preferably at least one full turn is achieved, although a curl of even one-half or three-quarters of a turn would significantly promote the objectives of this invention as compared to an edge, for example, which is intimately blocked against the roll and is difficult to start or grasp.

GENERAL ASPECTS OF THE INVENTION

As may have been noted above, the solvent is preferably applied to the finished roll by passing the same through the refluxing vapor of a boiling solvent whereas preferably, the coating would be applied to the film prior to the cut-off, and the cut-off would then be registered with the coating in order that the same would ultimately be located at the leading edge of the finished roll. The steps can be reversed, of course, such as by brushing or otherwise treating a strip of the film with solvent, and then registering the cut-off with the treated area. Also a coating in particular situations might advantageously be applied to the finished roll.

The rolls as taught herein are contemplated particularly for use with standard one-use, consumer type dispensing carton, in the known manner. Exemplary of such cartons would be the trunk lid style carton as typified by the cartons shown in U.S. Pat. Nos.

2,096,837, 2,226,477, 3,118,581, 3,129,870, and 3,549,066; and the conventional flap lid style carton which is illustrated in certain various forms thereof in U.S. Pat. Nos. 1,972,069, 2,433,445, 2,463,375, 2,472,521, 2,624,501, and 2,888,181. These patent teachings are hereby incorporated herein by reference.

Various modifications of the invention are, of course, possible without material deviation from the general principles and teaching hereof. For example, the curl need not be across the entire width of the roll, but may be selectively located at a corner or mid-area of the edge. It is intended that such non-material deviations and/or modifications be covered by the appended claims.

What is claimed is:

1. A roll of consumer type plastic wrapping film wound on a core, the film being characterized as a film having inherent residual shrinkage due to orientation imparted to the film in the longitudinal direction during the manufacture thereof, the improvement which comprises, a coating adhered to one surface of the leading edge of the roll to induce curling of said edge, to thereby promote easy identification and grasping of same to initiate the use of the roll.

2. The combination of claim 1 wherein said roll is contained within a carton for dispensing the film.

3. The combination of claim 2 wherein said curl is at least about one full turn.

4. The combination of claim 3 wherein said coating comprises carnauba wax.

5. The combination of claim 1 wherein said film comprises a vinylidene chloride copolymer.

6. A roll of film contained within a dispensing carton and wherein the leading edge of the roll is curled by selectively induced shrinkage thereof to promote easy identification and grasping thereof to initiate dispensing of the roll.

7. The combination of claim 6 wherein said curl has been induced by solvent treatment.

8. The combination of claim 6 wherein said curl has been induced by adhering a coating to one surface of said leading edge.

9. The combination of claim 6 wherein said film comprises a vinylidene chloride copolymer.

10. The combination of claim 9 wherein said curl comprises at least about three-quarters of a turn or greater.

* * * * *